US007901336B2

(12) United States Patent
McDuffie

(10) Patent No.: US 7,901,336 B2
(45) Date of Patent: Mar. 8, 2011

(54) LOWER LEG AND FOOT REHABILITATION APPARATUS

(75) Inventor: John Michael McDuffie, Marco Island, FL (US)

(73) Assignee: John Michael McDuffie

( * ) Notice: Subject to any disclaimer, the term of this patent is extended or adjusted under 35 U.S.C. 154(b) by 134 days.

(21) Appl. No.: 12/380,796

(22) Filed: Mar. 4, 2009

(65) Prior Publication Data

US 2010/0228164 A1 Sep. 9, 2010

(51) Int. Cl.
*A63B 23/08* (2006.01)
*A61H 1/02* (2006.01)

(52) U.S. Cl. ..... 482/79; 482/132; 482/146; 482/907; 601/32

(58) Field of Classification Search ..... 482/79, 482/80, 91, 92, 131, 132, 139, 146, 147, 482/148, 904, 907; 601/27, 32, 34; 602/27–29
See application file for complete search history.

(56) References Cited

U.S. PATENT DOCUMENTS

| | | | | |
|---|---|---|---|---|
| 3,134,591 | A * | 5/1964 | Conn, Jr. et al. | 482/147 |
| 3,421,760 | A * | 1/1969 | Freeman, Jr. | 482/80 |
| 4,199,137 | A * | 4/1980 | Giguere | 482/79 |
| 4,515,362 | A * | 5/1985 | Lin | 482/51 |
| 4,739,986 | A * | 4/1988 | Kucharik et al. | 482/79 |
| 5,035,421 | A * | 7/1991 | Scheller | 482/79 |
| 5,368,536 | A * | 11/1994 | Stodgell | 482/79 |
| 6,238,325 | B1 * | 5/2001 | Oxford | 482/146 |
| 6,277,057 | B1 * | 8/2001 | Hayden | 482/79 |
| 6,283,897 | B1 * | 9/2001 | Patton | 482/79 |
| 6,602,172 | B1 * | 8/2003 | Aigner | 482/147 |
| 6,821,235 | B1 * | 11/2004 | Johnson et al. | 482/79 |
| 6,878,102 | B1 * | 4/2005 | Commisso | 482/79 |
| 6,923,751 | B2 * | 8/2005 | Oxford | 482/146 |
| 7,192,410 | B1 * | 3/2007 | Rodgers | 602/36 |
| 7,364,534 | B2 * | 4/2008 | Zoller et al. | 482/80 |
| 2006/0084554 | A1 * | 4/2006 | Bement | 482/79 |
| 2006/0217250 | A1 * | 9/2006 | Pearson | 482/146 |

FOREIGN PATENT DOCUMENTS

WO WO 2005044394 A2 * 5/2005

* cited by examiner

*Primary Examiner* — Loan Thanh
*Assistant Examiner* — Victor K Hwang

(57) ABSTRACT

The present invention is for the rehabilitation of stroke, brain or nerve damaged patients whose feet are paralyzed or unresponsive and must relearn lower leg and foot muscle control. A foot box can support a patient's foot with the foot box mounted above a flat base plate for movement by the patient. The foot box can be pivotally mounted by a swivel bearing to a shaft on the base plate with a forward end of the foot box supported by a wheel. A hemisphere support on the lower surface of the foot box permits movable support of the foot box when the swivel bearing is disengaged from the shaft and the wheel is raised. Attachments for the ends of handled pull cords are provided on the front corners and sides of the foot box. Pulleys on the base plate guide the pull cords.

6 Claims, 6 Drawing Sheets

FIG. 1B
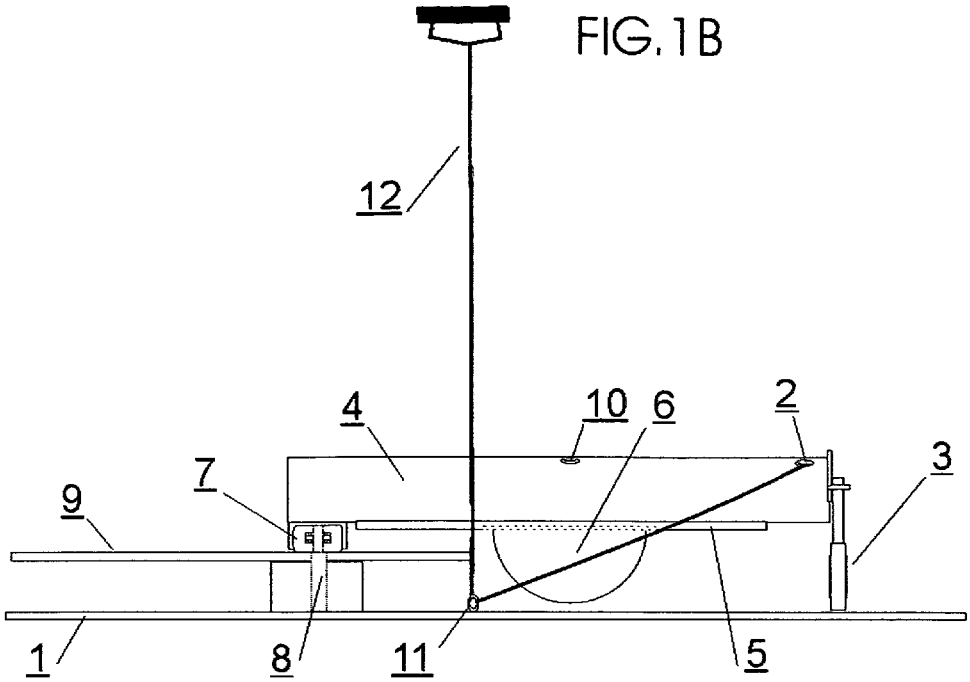
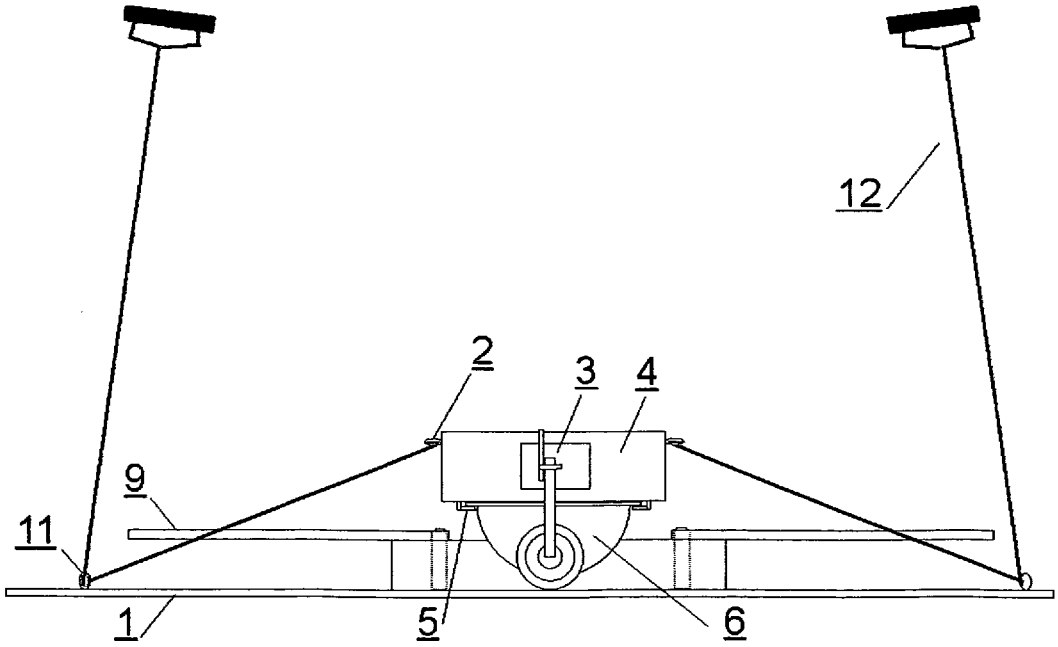
FIG. 1C

FIG.2B
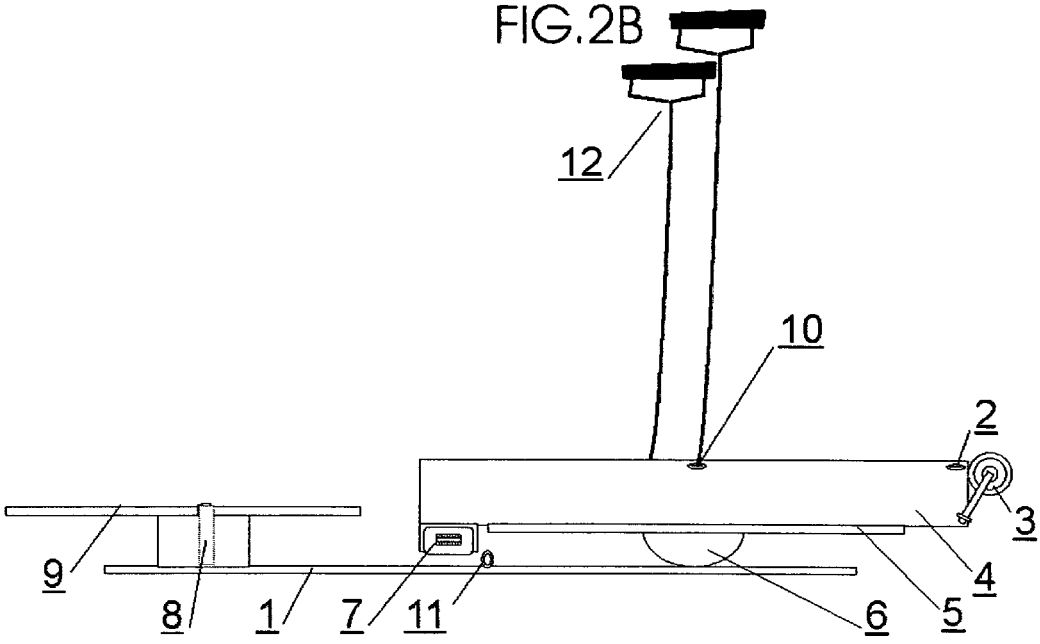
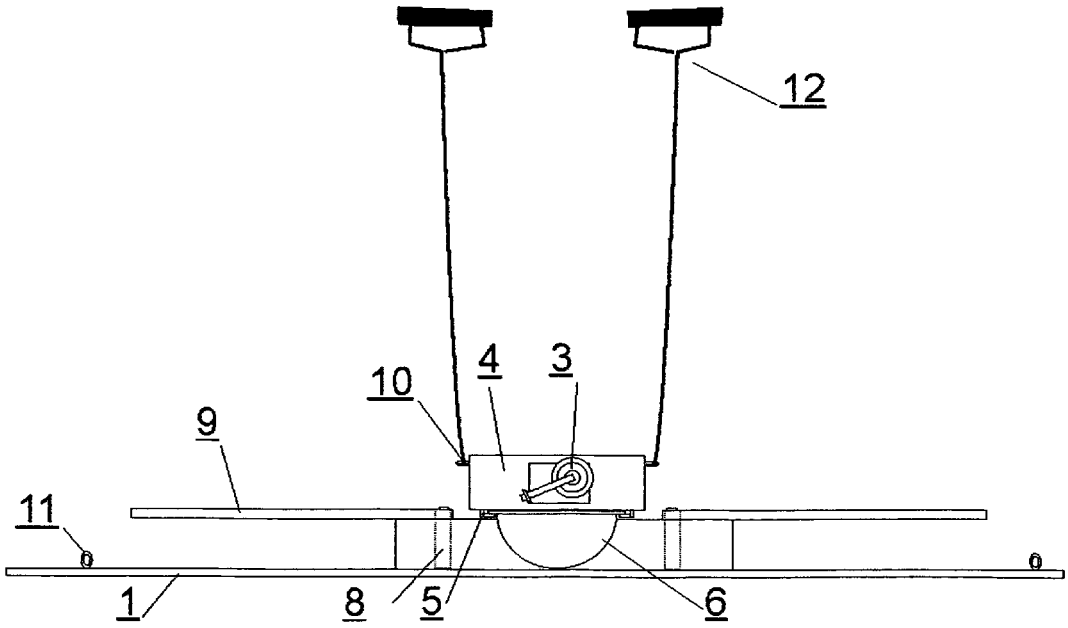
FIG.2C

FIG.3B
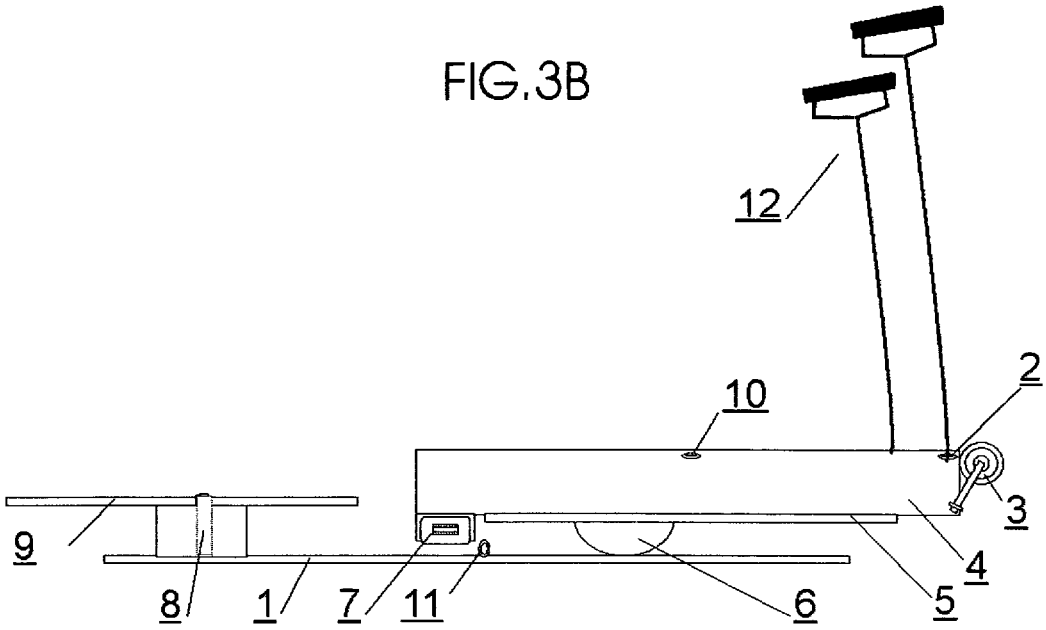
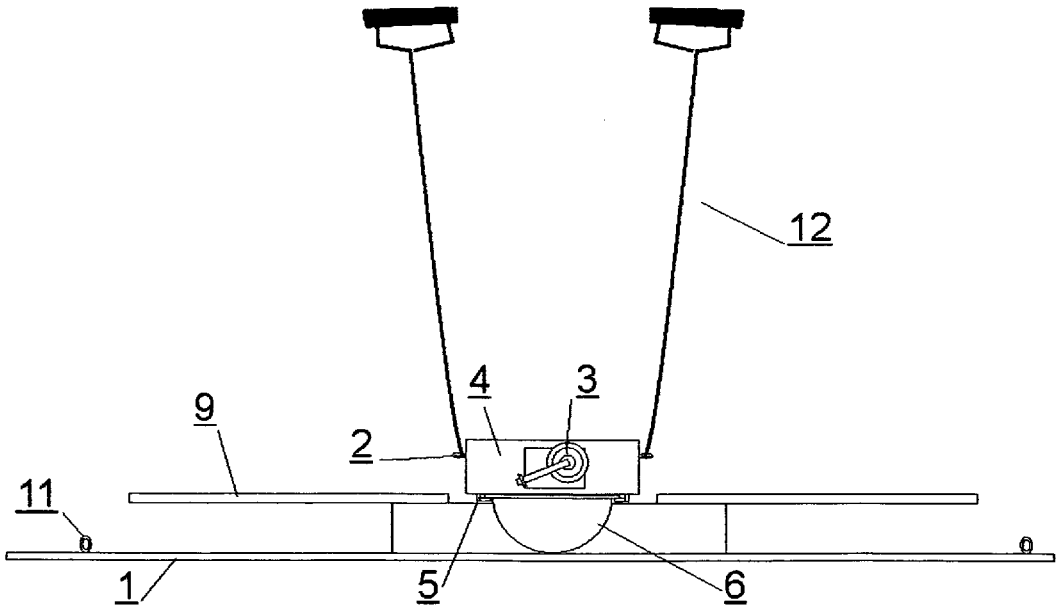
FIG.3C

LOWER LEG AND FOOT REHABILITATION APPARATUS

BACKGROUND OF INVENTION

1. Field of the Invention

The present invention relates to a rehabilitative therapy device more particularly, to a lower leg and foot muscle stimulation device. Due to Stroke, Brain or Nerve damage the patient loses mobility of the manipulative muscles working in the lower legs, and feet. If a patient does not acquire therapy soon after the incident permanent loss of mobility could occur. When used correctly this invention can greatly improve muscle mobility and control. Said invention has three separate parts referred to and shown as Parts, A) B) and C).

2. Description of the Related Art

Parts A) B) C) of the embodiment provide rehabilitative stimulation to the lower leg and foot muscles at all angles of deflection. Left, right, pivotal, up and down motions are operated by the sheer will of the patient, as well as, a gentle leading force from pull cords. This force is needed due to Stroke, Brain or Nerve damage, a patient's foot muscles become paralyzed, stiff and unresponsive. Rehabilitation of the lower legs and feet is necessary to regain mobility and reprogram motor skills.

SUMMARY OF THE INVENTION

The present invention is for the rehabilitation of stroke, brain or nerve damaged patients. Due to a stroke, brain injury or nerve damage a patients feet become paralyzed and unresponsive. The patient must relearn lower leg and foot muscle control. The invention has three separate parts. They are Parts A) B) C) of the embodiment which provide rehabilitative stimulation to the lower leg and foot muscles at all angles of deflection.

Part A). To achieve this and other objectives the Stroke Master invention has a flat plate base on which a foot box sets where the patient's foot is placed. The foot box is secured at the bottom back by a bearing, which allows the foot to swivel or turn left to right and a wheel at the bottom front that enables it to roll. Pull cords to pull left and right are attached to the front of the foot box; cords go through pulleys that are fastened to the outer edge of the flat base plate and are grasped by the patient or therapist's hands. A pulling force is applied to the cords as needed to help turn the foot left then right. The patient must relearn lower leg and foot muscle control. The patients alternate foot can remain standing on the plank with similar elevation. Unless patient is in a wheel chair then the movable plank can be removed. The above completes the summary of part A).

Part B). Using the same flat plate base and foot box the foot box is taken off the rear swivel and the front wheel is then placed into an inoperative position. The bottom of the foot box has a movable half round ball underneath it, which is placed on to the flat plate base. The removable pull cords are then attached to the sides of the foot box then grasped by the patient or therapist's hands. A pulling force is applied more to one side than the other this gives the muscles, nerves in the lower leg and foot stimulation. The patient must relearn lower leg and foot muscle control. The patient's alternate foot can remain standing on the plank at a similar elevation. Unless patient is in a wheel chair then the movable plank can be removed. The above completes the summary of Part B).

Part C). Last using the same flat plate base and foot box with the movable half round ball under it, the half round ball is slid backward allowing the front of the foot to drop. The pull cords are then reattached to the front of the foot box and placed in the patients or therapist's hands. A pulling force is then applied, pulling straight up as needed to raise the front of the foot. The patient must relearn lower leg and foot muscle control. The patient's alternate foot can remain standing on the plank with similar elevation. Unless patient is in a wheel chair then the movable plank can be removed. The above completes the summary of part C).

BRIEF DESCRIPTION OF THE DRAWINGS

FIGS. 1B and 1C are the side view and a front view of Part A.

FIGS. 2B and 2C are a side view and a front view of Part B.

FIGS. 3B and 3C are a side view and a front view of Part C.

DETAILED DESCRIPTION OF THE INVENTION

Figure 1A:
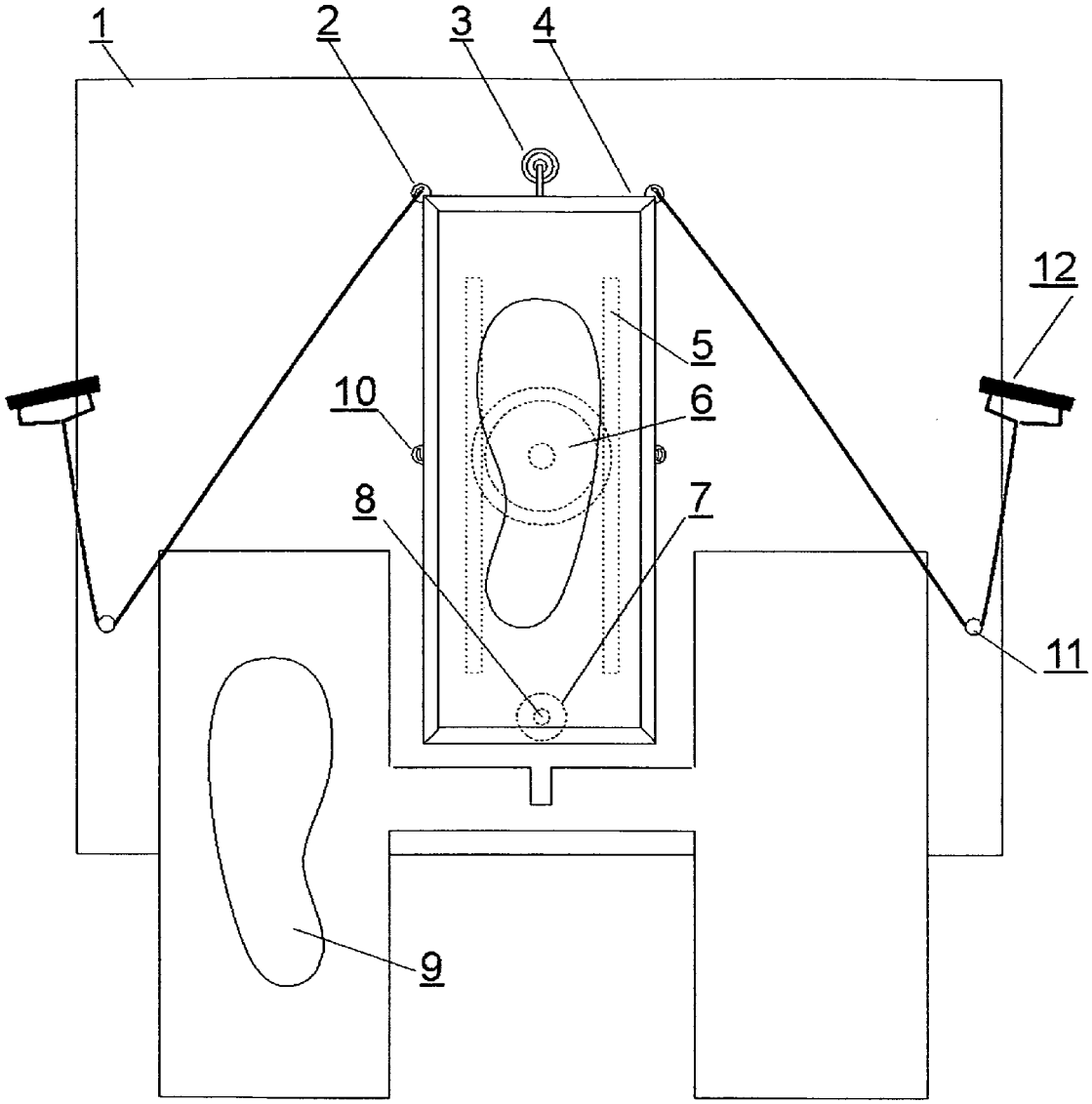
FIG. 1A is the top view of the stroke master Part A.

Referring to FIGS. 1A and 1B is operated by pull cords with handles 12 which are attached to the front corners 2 of the foot box 4 and run through pulleys 11 on each side of the flat plate base 1 then up to the patients or therapists hand grips. Patient places foot into foot box 4, which has a female swivel bearing 7 at the back under side. Female bearing slides on and off male shaft 8 fixed to the rear of the main plate form 1. A wheel 3 under the front of the foot box allows for side-to-side motion. The Patient's alternate foot can stand on movable foot plank 9. Foot plank 9 can be removed to allow for patients in wheel chairs to use foot box 4. The patient must use their own will, as well as, some force from the pull cords to stimulate and manipulate the foot muscles.

Figure 2A:
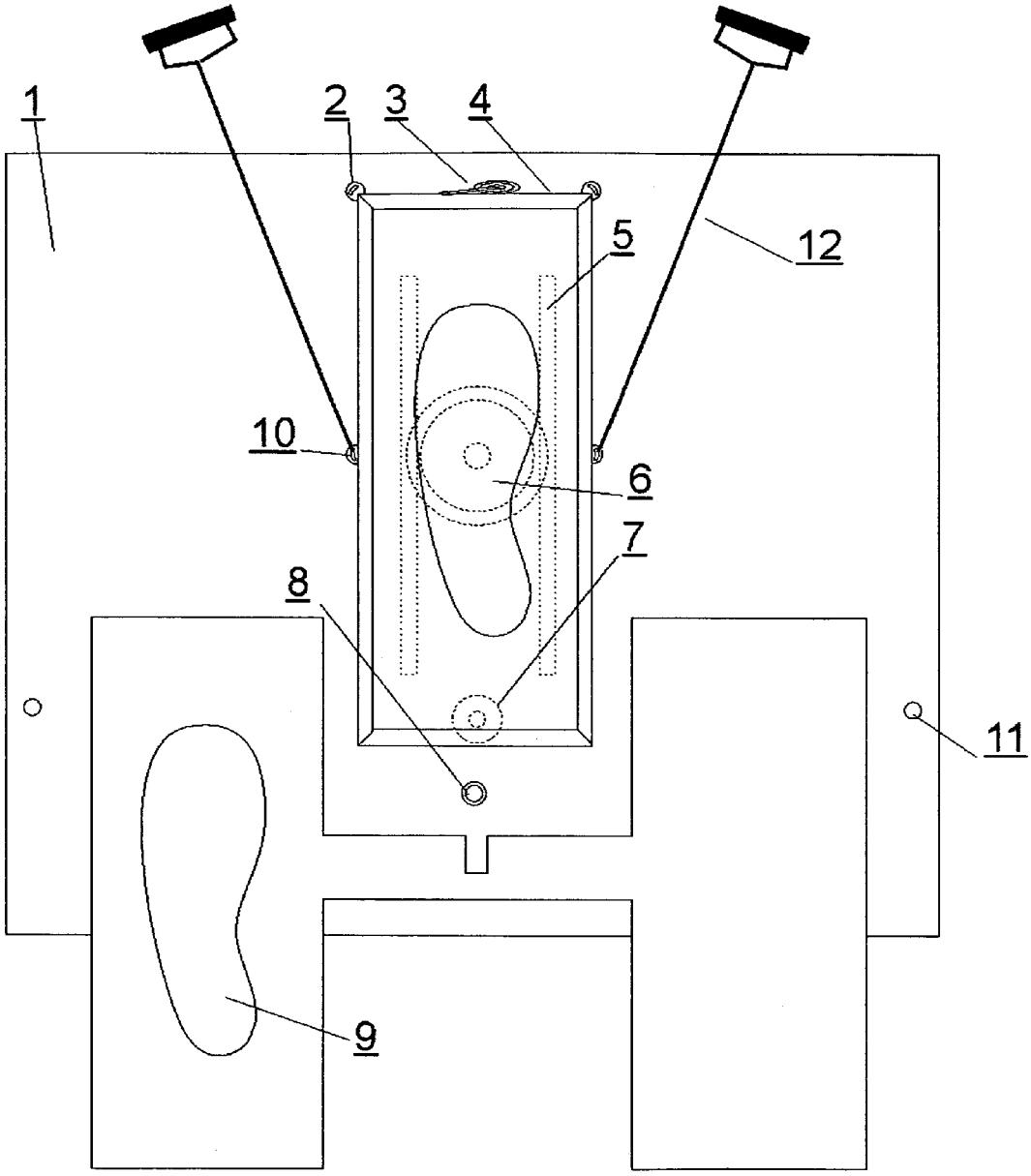
FIG. 2A is top view Stroke Master Part B.

Referring to FIGS. 2A and 2B is operated by pull cords with handles 12 that are attached 10 to the sides of the foot box 4. The foot box 4 is set forward off the rear male shaft 8 and the front wheel 3 on the foot box 4 is raised. The movable half round ball 6 on the under side of foot box 4 is placed onto the flat plate base 1 and the movable half round ball 6 is slid forward to the desired position in slide track 5; so that the foot remains level. The patient places foot in foot box 4, the patient's alternate foot can stand on the movable foot plank 9. Foot plank 9 can be removed to allow for patients in wheel chairs to use foot box 4. The pull cord handles 12 are placed into the patients or to the therapist's hands. A gentle force on the pull cords will allow the patient or therapist to bend the outer edge of the foot down on one side and up on the other. Then the patient or therapist reverses pulling the outer edge of the foot up and the inner side down. The patient must use their own will, as well as, some force from the pull cords to stimulate and manipulate the foot muscles.

Figure 3A:
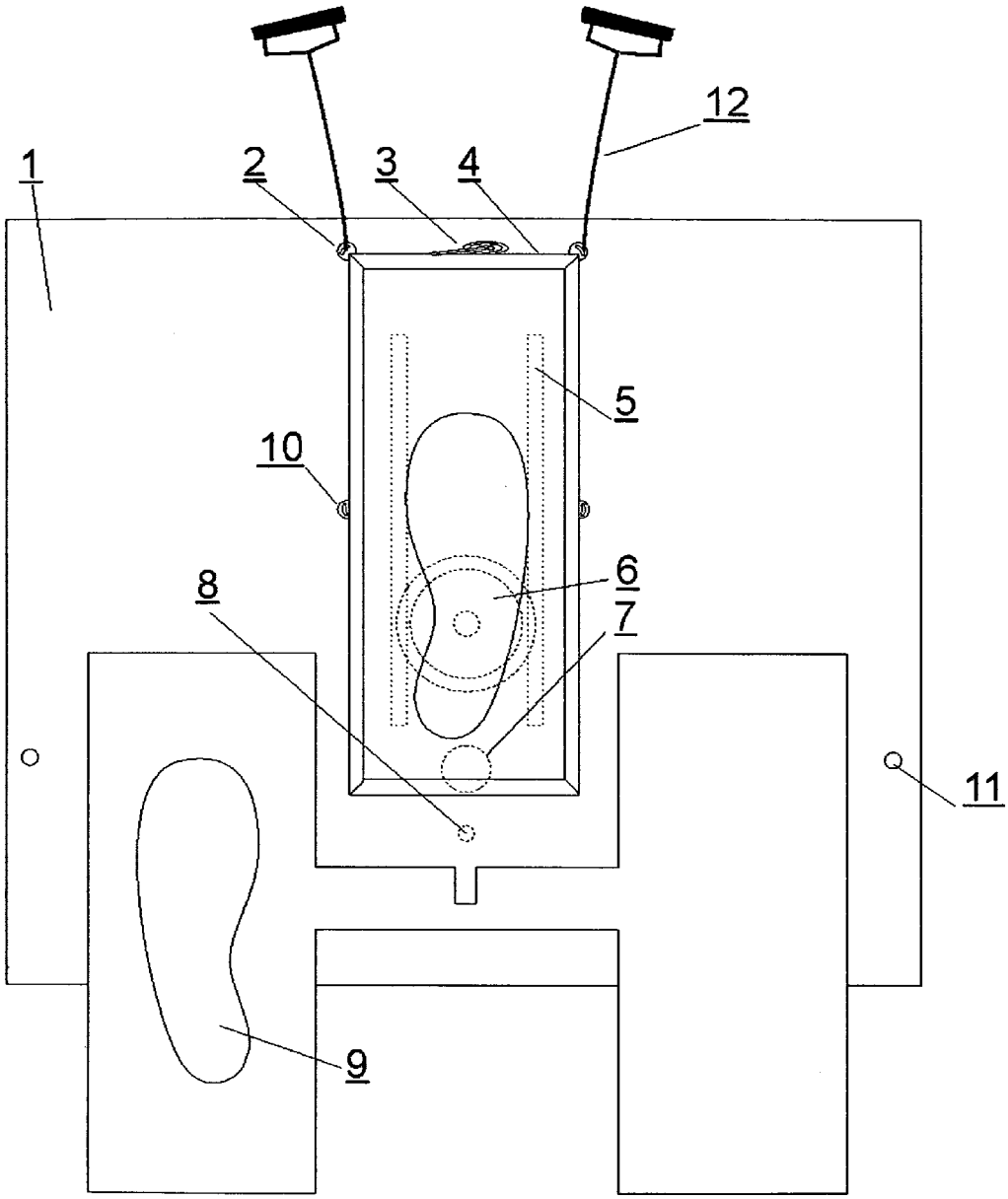
FIG. 3A is top view of the Stroke Master Part C.

Referring to FIGS. 3A and 3B is operated by pull cords with handles 12 that are attached to the front corners 2 of the foot box 4. The foot box 4 is set forward off the rear male shaft 8 and the front wheel 3 on the foot box 4 is raised. The movable half round ball 6 on the under side of foot box 4 is placed onto the flat plate base 1 and the movable half round ball 6 is slid rear to desired position in the slide track 5; so that the toes or front of the foot box drops. The patient places foot in foot box 4, the patient's alternate foot can stand on the movable foot plank 9. Foot plank 9 can be removed to allow for patients in wheel chairs to use foot box 4. The pull cord handles 12 are placed in the patients or therapists hands. The pull cords help the patient raise the front of the foot box. The patient must use their own will, as well as, some force from the pull cords to stimulate and manipulate the foot muscles.

Particular parts of the invention have been described in detail for the purpose of illustration; however, various modifications and enhancements may be made without departing from the spirit and scope of the invention. Also, the invention is not to be limited except as by the appending claims. The present invention can be used standing, sitting, laying or in a reclined position. Said invention can also be used with electric shock stimulation devices.

The invention claim is:

1. A lower leg and foot rehabilitation apparatus comprising:

a flat plate base having a shaft extending upwardly from a rear end from an upper surface of said flat plate base;

a foot box positioned above said flat plate base and having an upper surface configured to support the bottom of a patient's foot and a lower surface configured to engage with said flat plate base, said foot box having a swivel bearing located on the lower surface at a rear end of said foot box, a traversing support at a forward end of said foot box, and an arcuate support mounted to the lower surface of said foot box; and a pair of pull cords with handles at respective distal ends of said pull cords, each pull cord having a proximal end configured to be selectively attached to front corners of said foot box and to sides of said foot box, said flat plate base having a pair of pulleys to direct said pull cords to said foot box, wherein said apparatus can be used in at least three configurations to rehabilitate the lower legs and feet of a patient, a first configuration wherein said swivel bearing of said foot box is supported by said shaft of said flat plate base such that said foot box is rotatable about said swivel bearing and supported at the front end by said traversing support with the proximal ends of said cords attached to respective front corners of said foot box so that a patient placing their foot on said foot box can apply gentle force to the pull cords to relearn left and right motion, a second configuration wherein said swivel bearing is not supported by said shaft and said arcuate support of said foot box rests on the upper surface of said flat plate base with the proximal ends of said cords attached to respective sides of said foot box so that a patient placing their foot on said foot box can apply gentle force to the pull cords to relearn stabilization of their ankle as the ankle bends, and a third configuration wherein said swivel bearing is not supported by said shaft and said arcuate support of said foot box rests on the upper surface of said flat plate base with the proximal ends of said cords attached to respective front corners of said foot box so that a patient placing their foot on said foot box can apply gentle force to the pull cords to relearn picking up of dropped foot.

2. The rehabilitation apparatus of claim 1, wherein said traversing support comprises a wheel mounted to said foot box to be selectively raised and lowered.

3. The rehabilitation apparatus of claim 1, wherein said arcuate support is mounted to the lower surface of said foot box to be selectively positioned along a length of said foot box between the forward and rear ends.

4. The rehabilitation apparatus of claim 3, wherein said arcuate support is mounted to a slide track on the lower surface of said foot box.

5. The rehabilitation apparatus of claim 1, further comprising a movable foot plank selectively positioned on said flat plate base to support a patient's alternate foot.

6. The rehabilitation apparatus of claim 1, wherein said arcuate support is a hemispherical support.

* * * * *